United States Patent [19]

Radtke et al.

[11] Patent Number: 5,005,751

[45] Date of Patent: Apr. 9, 1991

[54] SHEET STACKING AND STAPLING APPARATUS

[75] Inventors: Manfred Radtke, Korb; Friedrich Ueffinger, Schorndorf-Weiler, both of Fed. Rep. of Germany

[73] Assignee: Eastman Kodak Company, Rochester, N.Y.

[21] Appl. No.: 437,005

[22] Filed: Nov. 15, 1989

[30] Foreign Application Priority Data

Nov. 21, 1988 [DE] Fed. Rep. of Germany ..... 3839306

[51] Int. Cl.[5] ..... B27F 7/21

[52] U.S. Cl. ..... 227/111; 270/53; 227/151; 227/155

[58] Field of Search ..... 270/53; 271/178; 227/6, 227/7, 110, 111, 140, 150, 151, 78, 155

[56] References Cited

U.S. PATENT DOCUMENTS

| | | | |
|---|---|---|---|
| 3,735,978 | 5/1973 | Turner et al. | 271/178 |
| 4,358,042 | 11/1982 | Lawrence | 227/155 X |
| 4,444,491 | 4/1984 | Rinehart et al. | 227/155 X |
| 4,449,661 | 5/1984 | Spehrley, Jr. | 227/155 |
| 4,595,187 | 6/1986 | Bober | 270/53 X |
| 4,603,971 | 8/1986 | Kokucka et al. | 270/53 X |
| 4,771,922 | 9/1988 | Masada | 227/90 X |

*Primary Examiner*—Paul A. Bell

*Attorney, Agent, or Firm*—Lawrence P. Kessler

[57] ABSTRACT

At one end of a stacking area, abutments are arranged which extend into, and can be selectively moved out of, the feed path of sheets fed through such area to stack sheets in such area. In the area of the abutments, two oppositely arranged stapling devices are located which are movable parallel with the stack edge defined by the abutments and are adjustable to various stapling distances. The stapling devices engage a spindle with oppositely directed threads such that, when the spindle is rotated, the stapling devices are moved toward or away from each other. The stapling devices laterally substantially surround the stacking area from above and below adjacent to the edge defined by the abutments, but do not intercept the feed path. For this purpose they are provided with recesses through which the sheets can be brought into the stapling position adjacent to the stack abutments and the stacks after stapling can be readily removed from the stapling position.

9 Claims, 3 Drawing Sheets

SHEET STACKING AND STAPLING APPARATUS

BACKGROUND OF THE INVENTION

This invention relates to apparatus for stacking and stapling sheets wherein a stapling device is arranged in a housing which laterally substantially surrounds the stacking area from above and below but does not intercept the path of sheets through the apparatus.

Apparatus for stacking and stapling sheets are suitable for use, for example, in connection with reproduction equipment where copies reproduced in the equipment are compiled in a stack and stapled before further transport to a downstream location. An example of such apparatus is shown in U.S. Pat. No. 3,735,978. Such apparatus has a single stapling device which is arranged at one side of the stack. It is often desirable that a sheet stack be stapled along one edge by two staples which are located adjacent to the ends of such edge. U.S. Pat. No. 4,516,714 shows plural stapling devices, with the housings of said stapling devices being movable and adjustable transversely in the direction in which the sheets are fed into the stacking area. However, such arrangement does not have an unobstructed feed path through the stacking area; that is, sheets introduced into the stacking area have to be moved out of the stacking area in a direction opposite to the feeding direction after they have been stapled. Moreover, each stapling device housing is movable by a drive of its own which is controllable by a complicated control unit in a timed relationship with a drive of the other housing.

SUMMARY OF THE INVENTION

The sheet stacking and stapling apparatus according to this invention provides an unobstructed stacking area wherein the feeding direction of the sheets fed to the stacking area and removed from such area after stapling need not be changed. With the apparatus of this invention, at one end of a stacking area, abutments are arranged which extend into, and can be selectively moved out of, the feed path of sheets fed through such area to stack sheets in such area. In the area of the abutments, two oppositely arranged stapling devices are located which are movable parallel with the stack edge defined by the abutments and are adjustable to various stapling distances. The stapling devices engage a spindle with oppositely directed threads such that, when the spindle is rotated, the stapling devices are moved toward or away from each other. The stapling devices laterally substantially surround the stacking area from above and below adjacent to the edge defined by the abutments, but do not intercept the feed path. For this purpose they are provided with recesses through which the sheets can be brought into the stapling position adjacent to the stack abutments and the stacks after stapling can be readily removed from the stapling position.

Another advantage of this arrangement is that only one drive has to be moved for effecting a movement of the two housings, by which the stapling devices are adapted to different sizes of the stacked sheets (or different staple locations) so that a considerably simplified control is obtained.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
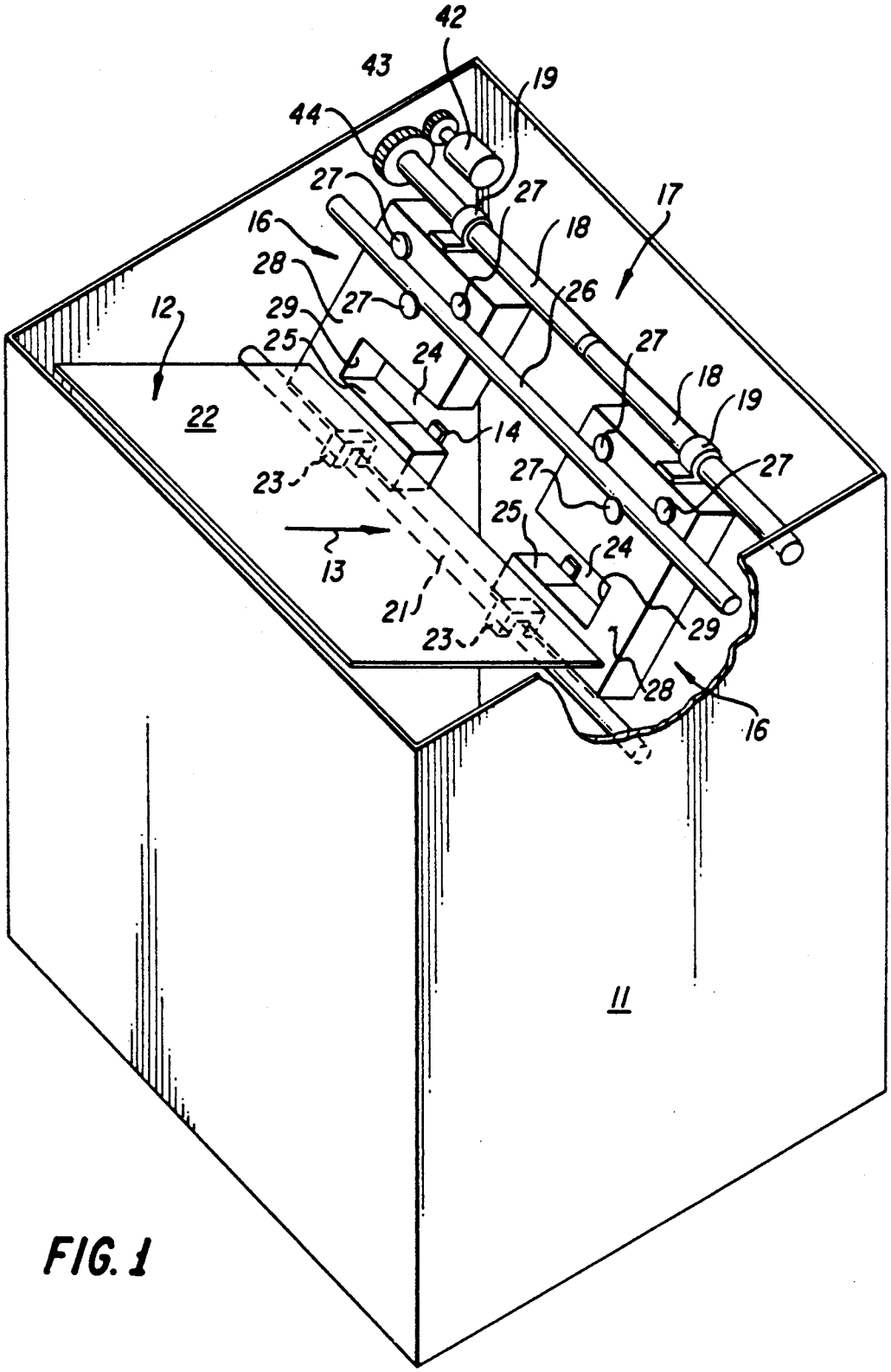
FIG. 1 shows a perspective view of a first embodiment of the apparatus for stacking and stapling sheets according to this invention.

Referring now to the accompanying drawings, the sheet stacking and stapling apparatus according to this invention is arranged in a housing 11 which has a stacking surface 12 with a slight downward inclination defining the lower side of a stacking area. Lateral guide means (not shown in the drawing), which can be adjusted to the different sizes of the sheets fed, are provided for guiding the sheets fed along a path to the stacking area from the upper edge of the stacking surface 12, as shown in FIG. 1, in a feeding direction 13 perpendicular to such edge. Apart from the surface 12 (and lateral guide means), the feed path through the stacking area is generally unobstructed so that the sheets fed individually along the path into the stacking area in the feeding direction 13 can be removed in the form of a stack after having been stacked in the same feeding direction 13. For stacking sheets, two abutments 14 are provided which, when in their stacking (abutment) position shown in FIG. 1, intercept the sheet feed path to define the stacking area at the lower side of the surface 12 against which an edge of sheets fed to the area are stacked, and which can be moved from said stacking position into a release position in which they are remote from the path so that a formed stack can be removed.

Two stapling devices 15, arranged in two housings 16 respectively, are provided for stapling sheets stacked in the stacking area. Each of the two housings is movable perpendicularly to the feeding direction 13 so as to be adjustable in various positions. A spindle 17 with two oppositely directed threads 18 at either side of its center serves as a drive for moving the two housings 16. On each of the respective housings 16, an eyebolt 19 having internal threads is arranged to engage the respective threads of the spindle 17 so that when the spindle is rotated, the housings 16 are moved by equal distances in opposite directions perpendicularly to the feeding direction 13. In order to keep the stapling devices 15 arranged in the housings 16 in their positions perpendicular to the stacking surface 12 as required for stapling, the housings 16, connected at their upper ends with spindle 17, are guided at their lower ends by a guide rail 21 which extends parallel with spindle 17 and is located below the stacking surface 12. The stacking surface 12 is formed by an inclined plate 22 which terminates at its lower end in front of the housings 16 so that the housings can extend to a position below the stacking surface 12. The housings are provided at their lower ends with guide means in the form of shoes 23 which substantially surround the guide rail 21. In order that the two housings 16 can be guided without jamming, a second guide rail 26 is provided which extends parallel with spindle 17 and is held in engagement with guide means in the form of three rollers 27 mounted on the front side of the housings as seen in FIG. 1. Spindle 17 is driven by means of a motor 42 controllable by a control unit (not illustrated in the drawings). The pinion 43 of the motor 42 meshes with a gear wheel 44 connected with the spindle 17. When the sheet size to be stacked (or the location of the staples) is input into the central control unit, motor 42 is moved such that the two housings 16 are moved into the positions matching the size concerned.

The housings 16 respectively have recesses 24 for laterally substantially surrounding the stacking area from above and below adjacent to the edge of the stacking area defined by the abutments 14. The lower sides 25 of recesses 24 are aligned with the upper surface of plate 22 and thus define an extension of the stacking surface 12. The side walls of each housing 16 are formed by mounting plates 28 of which the plate forming the front wall is visible in FIG. 1 and the plate forming the rear wall is visible in FIG. 2. Both mounting plates have openings 29 on their sides facing the stacking area, the openings of the mounting plates of each housing being arranged to coincide and thus form the housing recess 24. Between the two mounting plates, the stapling device 15 (illustrated in FIG. 2) is arranged above and below housing recess 24. Of course, various types of stapling devices are known and any of such known stapling devices can be used in conjunction with this invention.

Figure 2:
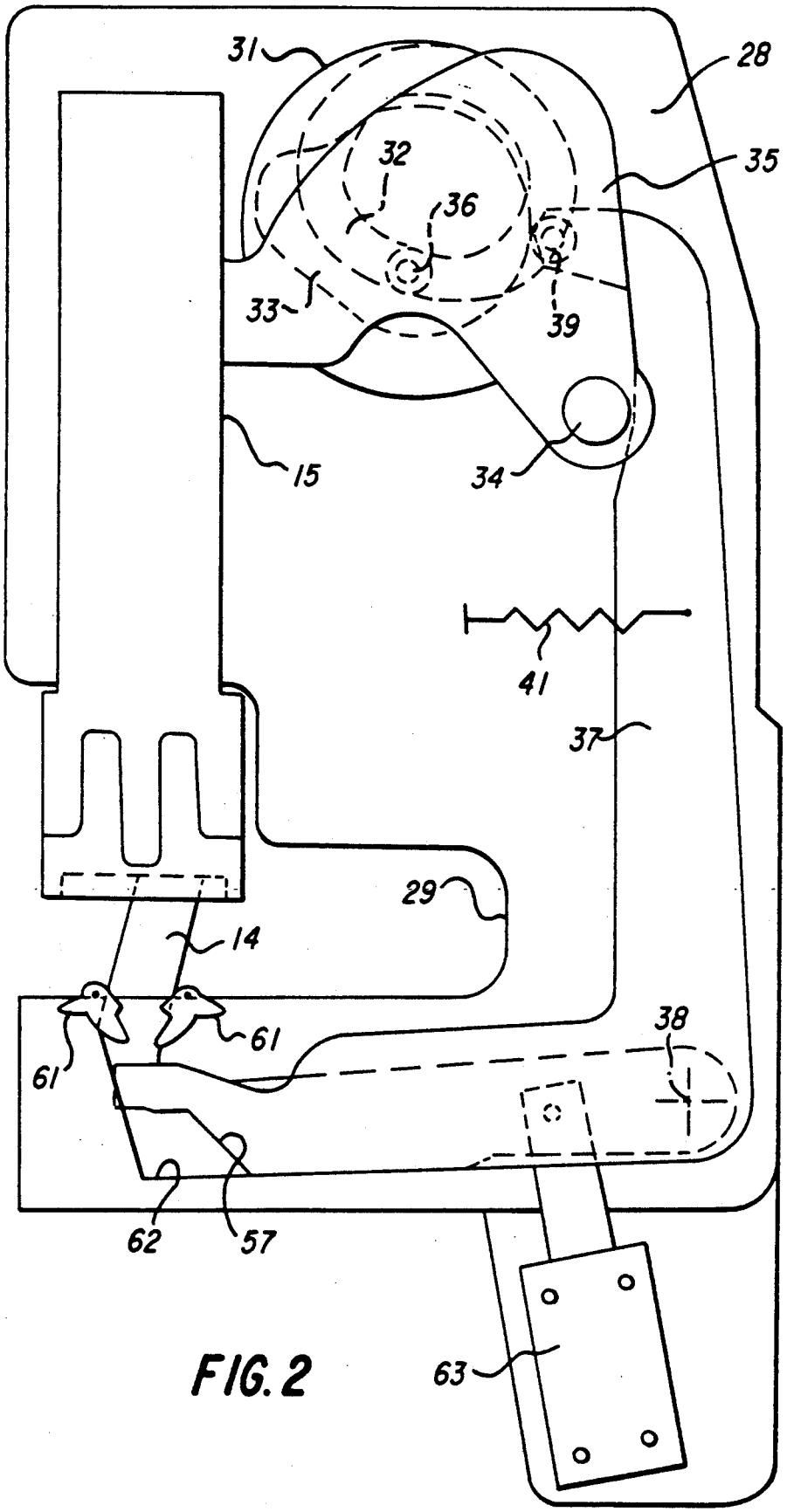
FIG. 2 shows a side view of a mounting plate forming a side wall of a housing of a stapling device for the sheet stacking and stapling apparatus, along with the drive for the stapling device and the stacking abutment.

A cam 31 (see FIG. 2) serves as a drive to operate stapling device 15. The cam 31 has a groove 32 and a lobe 33. A lever 35, pivotable about a journal 34, carries a roller 36 which rides in groove 32. Lever 35 engages the stapling device 15 through a slot. When cam 31 is rotated, lever 35 is moved up and down and operates the stapling device 15 in a known manner. Further, a two-arm lever 37 is mounted for pivotal movement about a journal 38 between the two mounting plates 28. The upper end of one arm, as seen in FIG. 2, carries a roller 39 and is urged by a spring 41 in a direction such that the roller 39 contacts the circumferential surface of the lobe 33. With its lower end 57, lever 32 operates deflecting elements 61 in a manner usual in the stapling devices to bend the stapling wire. The groove 32 and the lobe 33 are arranged in a relation to each other such that when cam 31 is rotated, lever 35 is moved first and lever 37 thereafter. Meanwhile, the abutment 14 is actuated via another lever 62, which is pivotable about journal 38 and movable by means of a solenoid 63.

Figure 3:
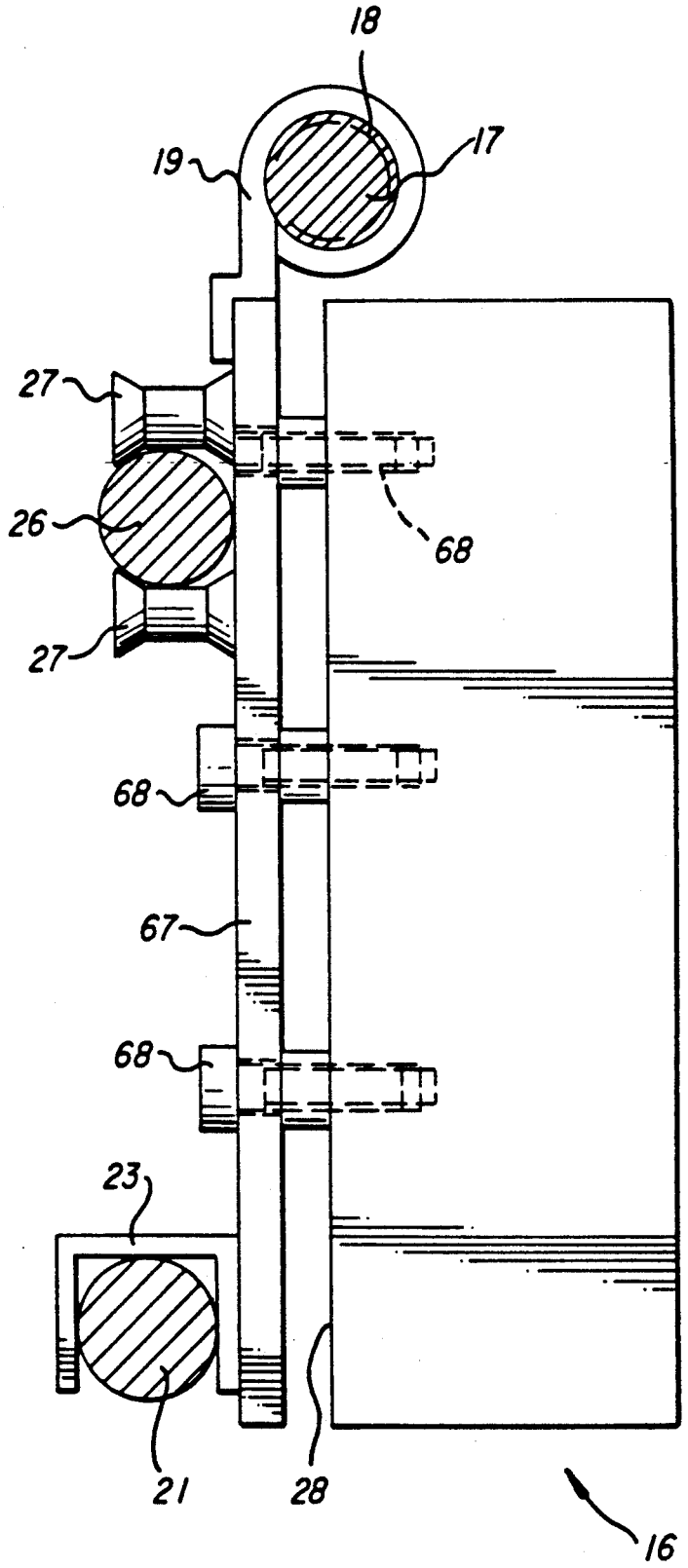
FIG. 3 shows an end view of a housing for an alternate embodiment of the sheet stacking and stapling apparatus according to this invention.

In a modified embodiment shown in FIG. 3, a supporting plate 67 is provided which is secured to the mounting plate 28 of the housing 16 by screws 68. The eyebolt 19 having the internal thread, the guide rollers 27 and the guide shoes 23 are arranged on the plate 67. As a result of the engagement and guide means for the housing 16 being provided on the supporting plate 67 separate from the housing and being mounted to the housing by screws 68, no readjustment is necessary when housing 16 is replaced. The housing 16 concerned is just unscrewed from the supporting plate 67 which is not removed from the apparatus. Since supporting plate 67 need not be readjusted, the replacement housing 16 is automatically adjusted in its correct position after it has been screwed to the supporting plate 67. The supporting plate 67 is shaped such that it does not cover the recess 24 of housing 16.

The invention has been described in detail with particular reference to preferred embodiments thereof, but it will be understood that variations and modifications can be effected within the spirit and scope of the invention as described hereinabove and as defined in the appended claims.

We claim:

1. Apparatus for stacking and stapling sheets, said apparatus comprising:

a stacking area through which sheets can be fed along a path in one feeding direction;

an abutment which is selectively movable from a releasing position remote from said sheet path into an abutment position intercepting said sheet path, in which it limits the stacking area, and back again, and against which an edge of sheets fed to the stacking area can be stacked when it is in its abutment position; and means for stapling sheets stacked against said abutment, said stapling means laterally substantially surrounding the stacking area from above and below, but not intercepting said sheet path.

2. Apparatus of claim 1 wherein said stapling means comprises:

a pair of housings located on opposed sides of the stacking area, each housing supporting a stapling device;

said housings being movable and adjustable transversely to said sheet path; and a common drive means for a simultaneous movement of both housings in opposite directions.

3. apparatus according to claim 2 further including an abutment associated with each housing.

4. Apparatus according to claim 2 wherein, for each housing, the side walls thereof take the form of two mounting plates, each mounting plate having on its side facing the stack area a recess such that the recesses of both mounting plates define a housing recess through which sheets can pass freely, and said stapling device being arranged between said two mounting plates above and below said housing recess.

5. Apparatus according to claim 2 wherein said drive means comprises a spindle which has two oppositely directed threads, and means for effecting engagement of said threads with said housing respectively.

6. Apparatus according to claim 5 wherein said engagement effecting means includes a pair of eyebolts, attached to said pair of housings respectively, each of said eyebolts having an internal thread.

7. Apparatus according to claim 5 further including at least one guide rail extending parallel with said spindle and cooperating with at least one guide means which is connected with said housing.

8. Apparatus according to claim 7 wherein said guide means includes three rotary guide rollers held in engagement with said guide rail.

9. Apparatus according to claim 7 wherein said engagement effecting means is arranged at one end of each of said housings, and said guide rail is arranged at the opposite ends of said housings.

* * * * *